United States Patent [19]

Gregory et al.

[11] Patent Number: 4,512,409

[45] Date of Patent: Apr. 23, 1985

[54] MOONPOOL GUIDANCE SYSTEM FOR FLOATING STRUCTURES

[75] Inventors: Edward W. Gregory, Calgary, Canada; Thomas R. Danielson, Morgan Hill; Donald A. Eberwine, Fremont, both of Calif.

[73] Assignee: Exxon Production Research Co., Houston, Tex.

[21] Appl. No.: 541,620

[22] Filed: Oct. 13, 1983

[51] Int. Cl.[3] ..... E21B 15/02; E21B 41/04

[52] U.S. Cl. ..... 166/352; 175/10; 414/745; 166/349

[58] Field of Search ..... 166/338, 349, 352, 358; 175/7–10, 195; 405/224, 195; 414/22, 745

[56] References Cited

U.S. PATENT DOCUMENTS

| | | | |
|---|---|---|---|
| 2,470,279 | 5/1949 | Whited . | |
| 3,032,125 | 5/1962 | Hiser et al. . | |
| 3,142,343 | 7/1964 | Otteman et al. . | |
| 3,419,090 | 12/1968 | Van Dorn . | |
| 3,496,898 | 2/1970 | Morgan . | |
| 3,507,405 | 4/1970 | Jones et al. . | |
| 3,605,415 | 9/1971 | Mohlman . | |
| 3,667,240 | 6/1972 | Vilain . | |
| 4,077,525 | 3/1978 | Callegari et al. | 414/22 |
| 4,212,561 | 7/1980 | Wipkink . | |
| 4,304,433 | 12/1981 | Langowski | 414/22 |
| 4,440,220 | 4/1984 | McArthur | 166/85 |

FOREIGN PATENT DOCUMENTS

| | | | |
|---|---|---|---|
| 1220359 | 7/1966 | Fed. Rep. of Germany | 175/85 |
| 588340 | 1/1978 | U.S.S.R. | 175/85 |

*Primary Examiner*—Stephen J. Novosad
*Assistant Examiner*—Bruce M. Kisliuk
*Attorney, Agent, or Firm*—Mitchell D. Lukin; Marc L. Delflache

[57] ABSTRACT

A guidance system for centering and guiding various drill strings or risers within a moonpool of a floating structure, e.g. a caisson vessel. The system comprises one or more guidance vehicles. Each vehicle is movably mounted on a separate track. The tracks, in turn, are spaced about the moonpool wall and extend vertically along the wall of the moonpool from the top of the moonpool to a point near its bottom. Each vehicle has a frame and means to mount the frame on its respective track. Two side arms and a center arm are pivotably mounted on the frame and are movable between a closed position and an open position. Mounted at the outer end of each of the arms is an interchangeable workhead assembly which engages a drill string or riser to center and guide the drill string or riser when the arms are in their closed position. Individual lines controlled by winches above the moonpool are attached to each vehicle for independently raising and lowering that vehicle within the moonpool.

13 Claims, 13 Drawing Figures

FIG.8
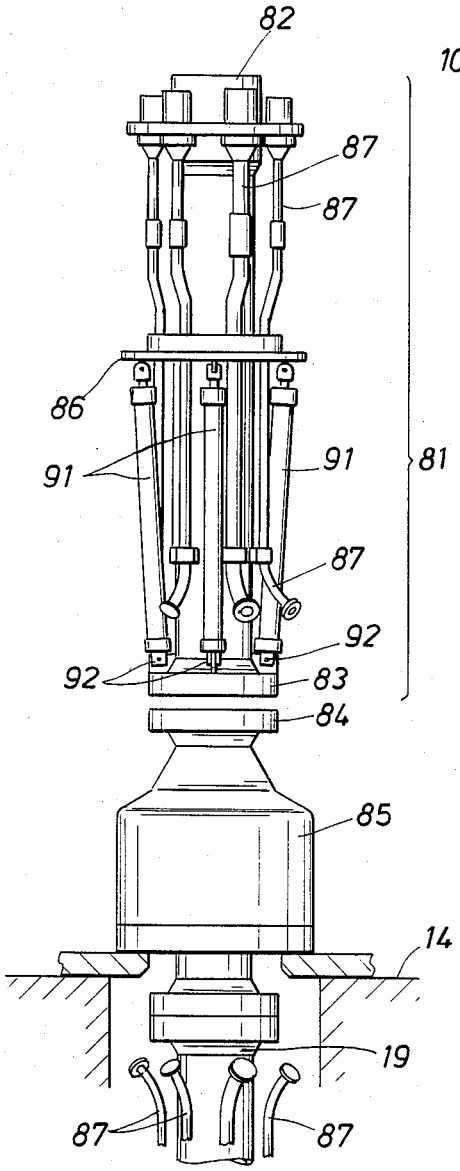
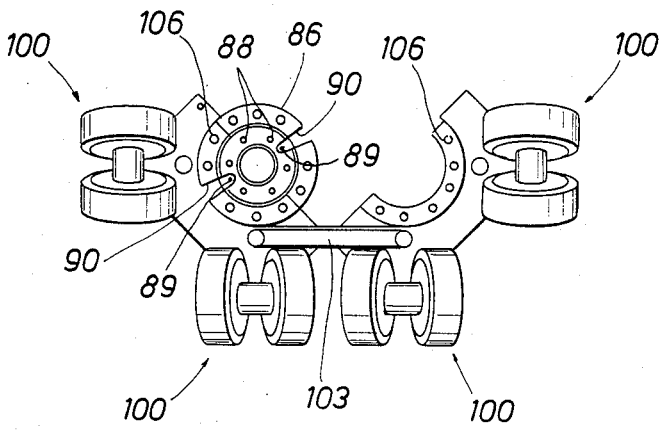
FIG.10
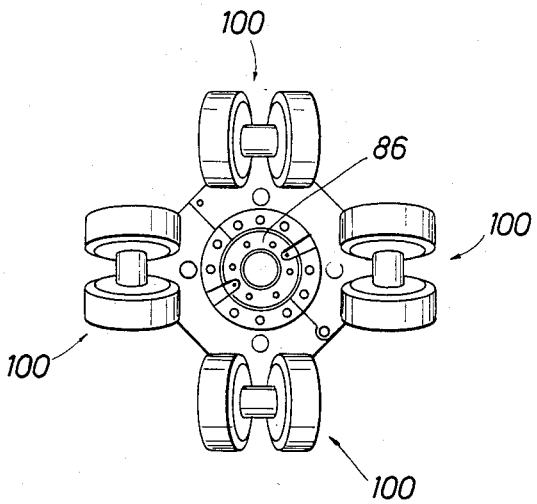
FIG.11

MOONPOOL GUIDANCE SYSTEM FOR FLOATING STRUCTURES

TECHNICAL FIELD

The present invention relates to apparatus for handling drill strings or risers from a floating structure and more particularly relates to a moonpool guidance system for centering and guiding drill strings or risers and related equipment through a moonpool of a marine drilling and/or completion structure.

BACKGROUND OF THE INVENTION

Floating structures, such as drill ships and semisubmersibles, have long been used to drill and complete subsea wells. Most of these floating structures have a large-diameter cylindrical opening, known as a moonpool, which extends vertically through the hull of the structure. The moonpool provides access from a work platform on the upper end of the structure into the water below. Most drilling and completion operations are carried out through the moonpool.

The work platform on a floating structure must remain relatively stable during the drilling and completion of a sebsea well. In extremely deep waters or in areas subject to high waves and strong winds, providing a stable floating platform can be a problem. One type of floating structure which is particularly adapted for use in such environments is the cassion vessel. A typical caisson vessel has an elongated, cylindrically-shaped hull, formed of concrete. The vessel has ballast tanks or compartments on its lower end and a work platform at its upper end. When in an operable position, the hull is moored vertically in the water with a substantial portion of the hull being submerged.

The submerged portion of the hull of the caisson vessel provides stability for the work platform. Once submerged, the bottom of the vessel may be as much as 500 feet below the surface of the water. Thus the moonpool, extending from the work platform completely through the hull, may also be 500 feet long. Unfortunately, it is difficult to raise or to lower drill strings and other such equipment through long moonpools without damaging the moonpool walls or the equipment being handled. Therefore, in moonpools of this type, some device must be provided which will engage the drill string or riser, and center and guide that drill string or riser while it is being lowered or raised through the moonpool.

If only the tubular members of a typical drill string or riser were involved, permanent guides could be positioned at desired intervals throughout the length of the moonpool. Sometimes, however, large equipment packages (such as BOP stacks and wellhead assemblies) must be attached to a drill string and run through the moonpool. Accordingly, for a moonpool guidance system to meet the practical requirements of routine drilling and completion operations, it must designed so that it may be moved out of the way to allow the unobstructed passage of such equipment packages. This retraction to provide unobstructed passage should be accomplished without the necessity of withdrawing the guidance system components from the moonpool.

Finally, due to the construction and flexibility of the different drill strings involved in the operations routinely carried out through the moonpool, the guidance system must be capable of moving to different depths within the moonpool. This allows the system to provide guidance for any particular drill string at the points most appropriate for that string. It also allows the guidance apparatus to maintain its position relative to a drill string while that string is being raised or lowered through the moonpool.

SUMMARY OF THE INVENTION

The present invention is a system for guiding drill strings through the moonpool of a floating structure. The basic component of the system is a vehicle which is free to move up and down the wall of the moonpool. The vehicle is composed of a frame on which is mounted equipment for engaging and centering drill strings or risers. Means are provided for actuating the engaging and centering equipment so as to move that equipment between open and closed positions. In the open position the engaging and centering equipment is retracted close to the moonpool wall to allow large equipment to pass the vehicle. In the closed position the engaging and centering equipment closes around the drill string or riser.

In the preferred embodiment described below, the system comprises two substantially identical guidance vehicles which are mounted on separate tracks. These tracks are positioned on the moonpool wall to allow the vehicles to pass each other within the moonpool. Each track extends vertically along the moonpool wall from the top of the moonpool to a point near the bottom thereof.

Each vehicle has roller assemblies for mounting the vehicle on its track. A pair of side arms is pivotably mounted at either side of the vehicle. The arms are movable between an open position and a closed position. A center arm is mounted about a horizontal pivot on the frame. This arm is also movable between open and closed positions. Remotely controlled hydraulic devices are provided on the frame for individually actuating each of the arms. In the open position the arms do not present a substantial obstruction to the passage of equipment through the moonpool.

Interchangeable workhead assemblies may be mounted on the outer ends of the arms to accommodate drill strings or risers of different configurations. With the arms in the closed position a workhead assembly mounted on the outer ends of the arms is brought into contact with a drill string or riser. This centers and guides the string or riser within the moonpool. One workhead assembly, for use with a riser, is comprised of three roller-beam units. One of these units is attached to each of the side arms and the center arm. The rollers on each beam are arranged so that they engage and guide the riser when the arms are in the closed position. Another workhead assembly is comprised of two funnel members, each attached to one of the side arms. When the side arms are moved to the closed position, the members form a funnel which encircles the string or riser being handled.

Each guidance vehicle can be independently raised and lowered in the moonpool by a line from a separate winch. Each winch is mounted on the work deck of the floating structure adjacent the top of the moonpool. By providing two independently movable guidance vehicles, the spacing and location of the vehicles within the moonpool can be varied to fit almost any given situation. Further, by making the arms on each vehicle retractable, the arms can be closed to center and guide a drill string or riser, and opened to allow large equipment packages to pass.

BRIEF DESCRIPTION OF THE DRAWINGS

FIG. 8 is an elevation of a flex joint centralizer spool;

FIG. 10 is a view looking down on the centralizing arm assembly of FIG. 9 in a partially assembled position on the spool of FIG. 8;

FIG. 11 is a view looking down on the centralizing arm assembly of FIG. 9 in an assembled condition on the spool of FIG. 8;

DESCRIPTION OF THE PREFERRED EMBODIMENTS

Figure 1:
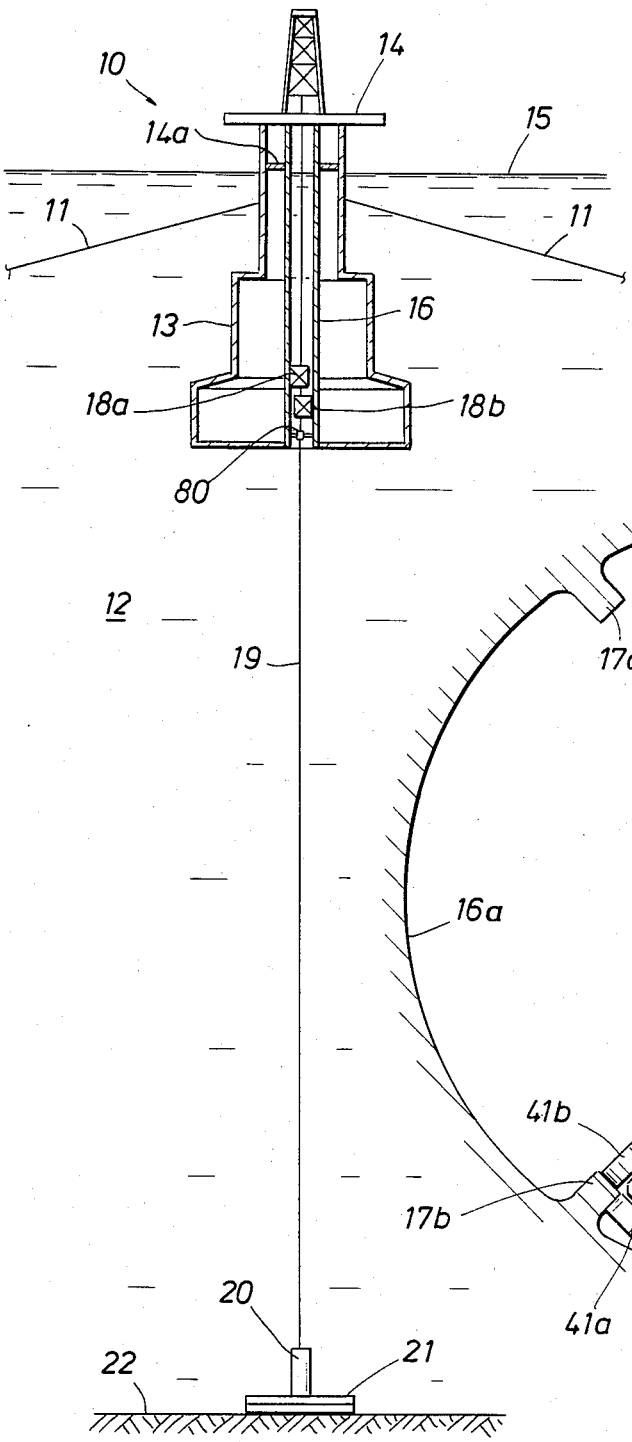
FIG. 1 is an elevation, partly in section, of a floating structure incorporating the present invention.

Referring to the drawings, FIG. 1 discloses a floating drilling and completion structure, caisson vessel 10, which is moored by anchor lines 11 in a body of water 12. As illustrated, vessel 10 has a stepped, cylindrically-shaped hull 13 which is vertically positioned in the water. When in an operable position, a substantial portion of hull 13 is submerged in order to provide a relatively stable work platform 14 above surface 15. A central, generally cylindrical opening, moonpool 16, is formed through the vertical axis of hull 13. Drilling and completion operations can be carried out from platform 14 through moonpool 16. Although structure 10 is described throughout as a caisson vessel, it should be recognized that the present guidance system can be used equally as well within the moonpools of other floating structures without departing from the present invention.

In carrying out operations from vessel 10, various drill strings and equipment must be raised and lowered through moonpool 16. The length of moonpool 16 is substantial in a typical caisson vessel. A guidance system must be provided to guide the drill string or riser and equipment through the moonpool and thereby prevent damage to the equipment or to the walls of the moonpool itself. To perform this function, the guidance system must be capable of engaging drill strings and risers of different configurations without damage. The guidance system must also be retractable to allow large equipment packages to pass unobstructed through the moonpool 16.

The guidance system of the present invention is shown schematically in FIG. 1. Here it is shown after having been used to guide a drill string 19, having a package 20 attached to its lower end, onto drilling template 21 positioned on marine bottom 22. The actual operational steps used in lowering drill string 19 and package 20 will be more fully described below. Flex joint centralizer 80, which is identified in FIG. 1, will also be discussed below.

The present guidance system comprises a first or upper guidance vehicle 18*a* and a second or lower guidance vehicle 18*b* (FIG. 1). Vehicles 18*a*, 18*b* are mounted on tracks attached to the walls of moonpool 16. The tracks for the two vehicles are preferably located on opposite sides of the moonpool wall.

Figure 2:
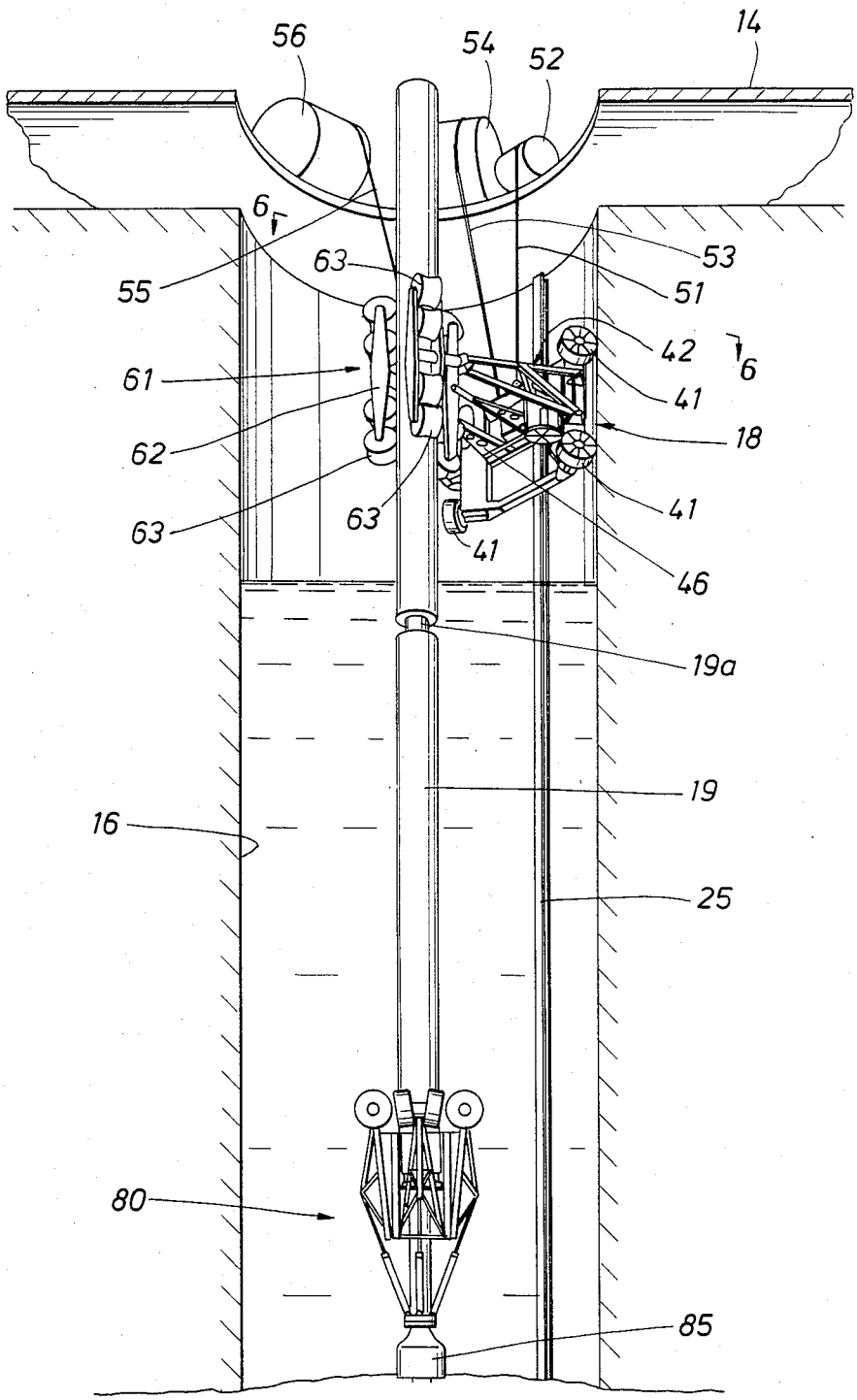
FIG. 2 is a perspective view, partly in section, of a guidance vehicle of the present invention in an operable position within a moonpool of a floating structure.

A first embodiment is shown in FIG. 2. For purposes of clarity in describing the invention, only one vehicle 18 (18*a* or 18*b* in FIG. 1) is shown in FIG. 2; however, as discussed above, the use of two or more similar vehicles in a single moonpool is contemplated.

FIG. 2 shows vehicle 18 mounted on monorail 25. For multivehicle configurations, separate monorails would be used for each vehicle. Monorail 25 extends from the top of moonpool 16 to a point near its bottom. The bottom of monorail 25 is the lowermost point of travel for a guidance vehicle.

Each guidance vehicle is raised and lowered on its monorail 25 by a respective line 51. Each line 51 runs to a separate winch 52 mounted on platform 14 adjacent moonpool 16. A separate umbilical line 53 from a separate winch 54 supplies hydraulic fluid to each vehicle for remote operation of the actuating means for arms 42 and 46. The same line 53 provides electrical power for operating lights and a closed-circuit television camera (not shown). It is preferable to mount a camera on each guidance vehicle. An umbilical 55 from winch 56 may be run with drill string or riser 19 to supply power to operate equipment on the marine bottom. Flex joint centralizer 80 and flex joint 85 are discussed below.

Figure 3:
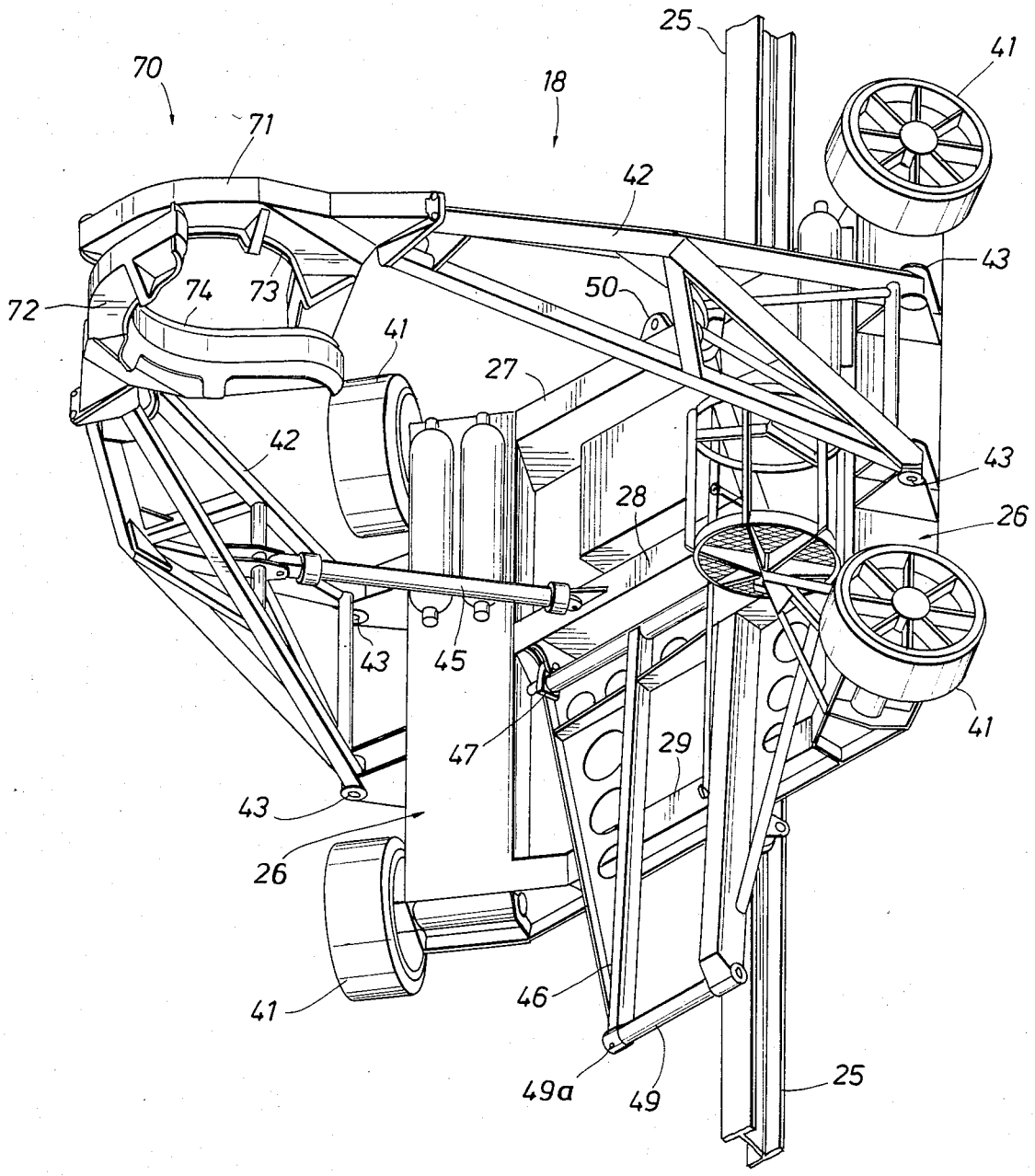
FIG. 3 is a perspective view of the guidance vehicle of the present invention with a funnel workhead assembly attached.

FIG. 3 is a more detailed view of guidance vehicle 18. Here guidance vehicle 18 is shown with funnel workhead assembly 70 attached. Funnel workhead assembly 70 will be discussed in more detail below.

As seen in FIG. 3, guidance vehicle 18 has a frame having two side structures 26, and upper, intermediate, and lower cross supports 27, 28, and 29. Two identical side arm assemblies 42 are mounted at either side of the frame by vertical pivot pins 43. Each arm 42 is a truss structure having an outer end to which a tool-handling workhead (to be described below) can be attached. Remotely controlled hydraulic cylinders 45 (only one shown in FIG. 3) are connected between cross support 28 of the frame and arms 42 to rotate the arms about their pivots.

Center arm 46 is mounted on cross support 28 about horizontal pivot 47 so that the arm can be swung up to an operable or closed position or down to a stowed or open position. Center arm 46 is displayed in an open position in FIG. 3. Center arm 46 is moved between closed and open positions by remotely controlled hydraulic cylinder 48 (shown in FIG. 6). Spindle 49 is provided on the outer end of center arm 46 for attachment of a tool-handling workhead. A fitting 50 is affixed to upper cross support 27. A lift line 51, as shown in FIG. 2, is attached to fitting 50 and used to raise and lower vehicle 18 in the moonpool.

Upper and lower monorail roller assemblies 30, 31 (FIG. 5) are mounted on the back of upper and lower cross supports 27, 29, respectively. Each monorail roller assembly 30, 31 is identical so only one such assembly will be described in detail.

Figure 4:
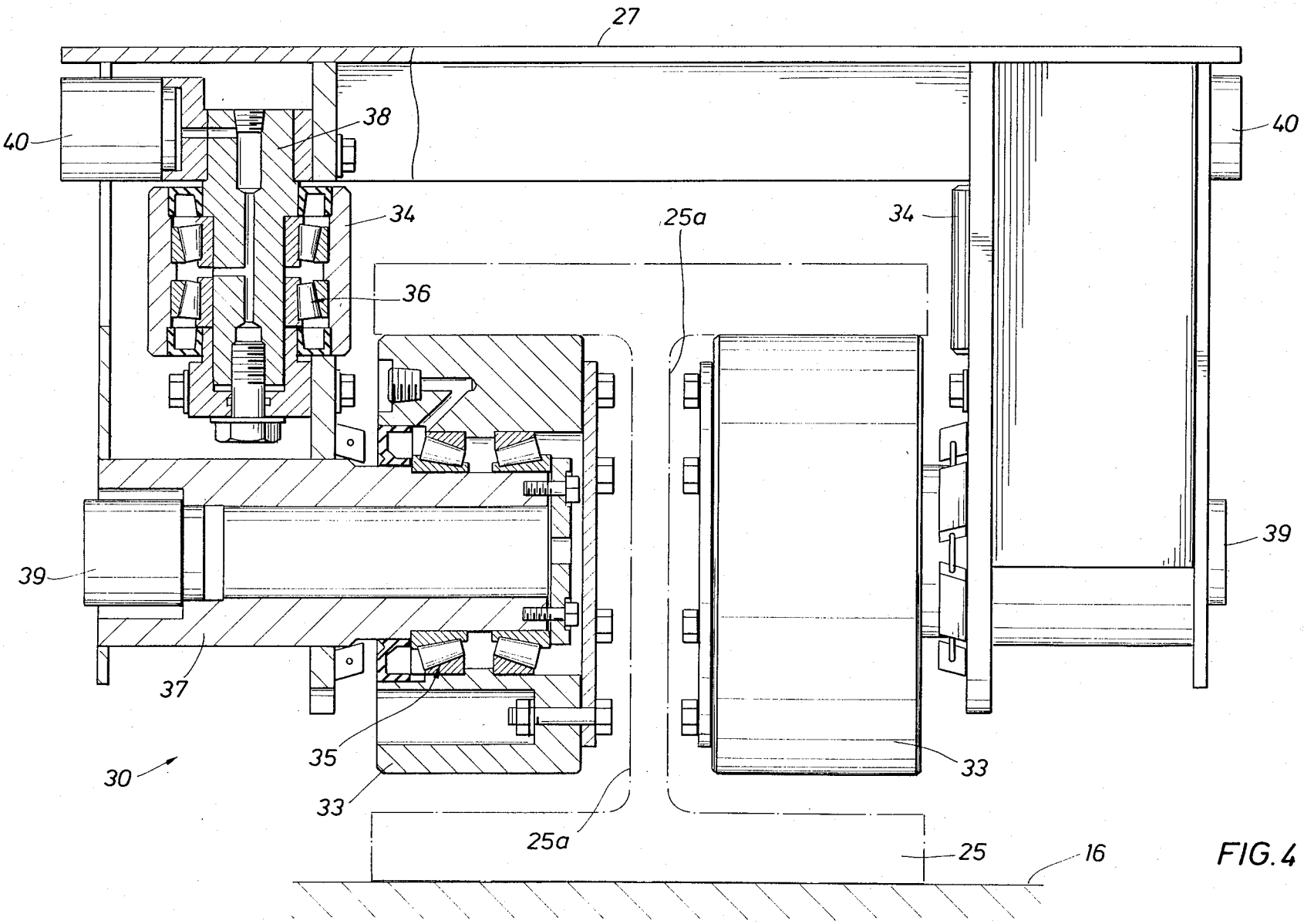
FIG. 4 is a plan view, partly in section, of the roller assembly used to mount the guidance vehicle on a monorail in the moonpool.

Monorail roller assembly 30 (FIG. 4) has a pair of identical rollers 33. When vehicle 18 is mounted on the monorail one roller 33 is positioned under each side of monorail 25 (i.e. one roller 33 in each channel 25*a* of I-beam 25). Two smaller rollers 34 which bear on the edges of monorail 25 position the vehicle laterally. Rollers 33, 34 are supported on bearings 35, 36 respectively. Bearings 35, 36 are positioned on stationary spindles 37, 38 respectively. Each bearing 35, 36 runs in a sealed cavity that is completely packed with a water repelling grease.

The guidance vehicle will be exposed to different ambient pressures as it operates at various depths. This makes it very important that the sealed bearing cavities be completely filled with grease, leaving no air bubbles. To equalize internal and external cavity pressures and to assist in completely filling the cavities, spring loaded piston lubricators 39, 40 are provided. Lubricators 39, 40 provide a reservoir of grease under spring pressure to assure complete cavity filling. As the unit is submerged in water, pressure acts on the outside of each piston to force more grease into each bearing cavity. This equalizes the pressures on the inside and outside of the cavity seals.

Mounted on each corner of the frame are wheels 41 (FIG. 3) which are supported by roller bearings. Each bearing is positioned on a spindle in a grease-filled cavity (details not shown). A lubricator (not shown) similar to that described above is provided for each wheel 41 to ensure adequate lubrication as the vehicle moves up and down in moonpool 16. Wheels 41 roll against the wall of moonpool 16.

Figure 6:
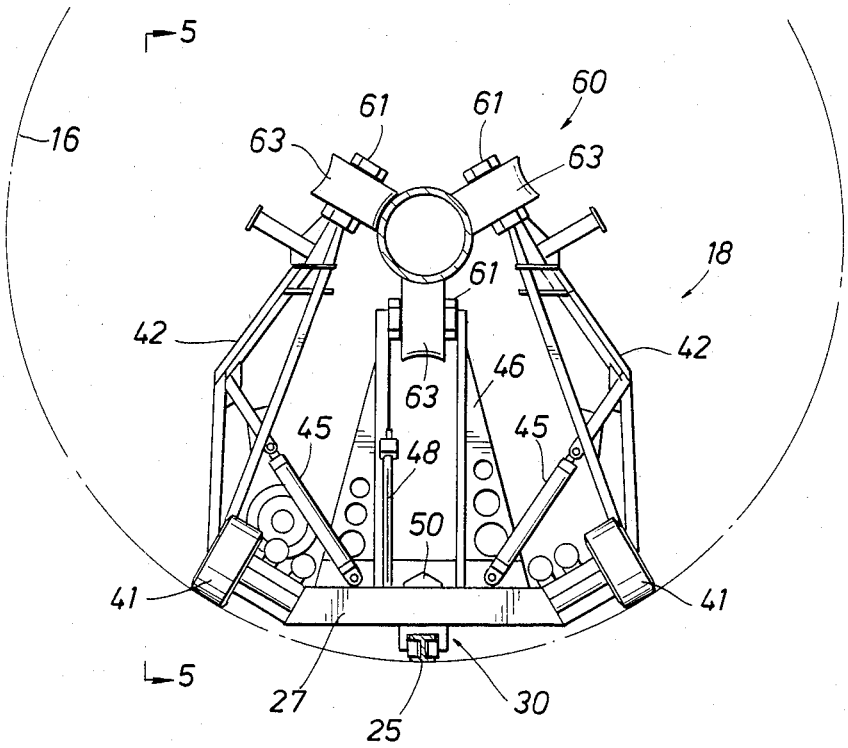
FIG. 6 is a plan view taken along line 6—6 of FIG. 2.
Figure 5:
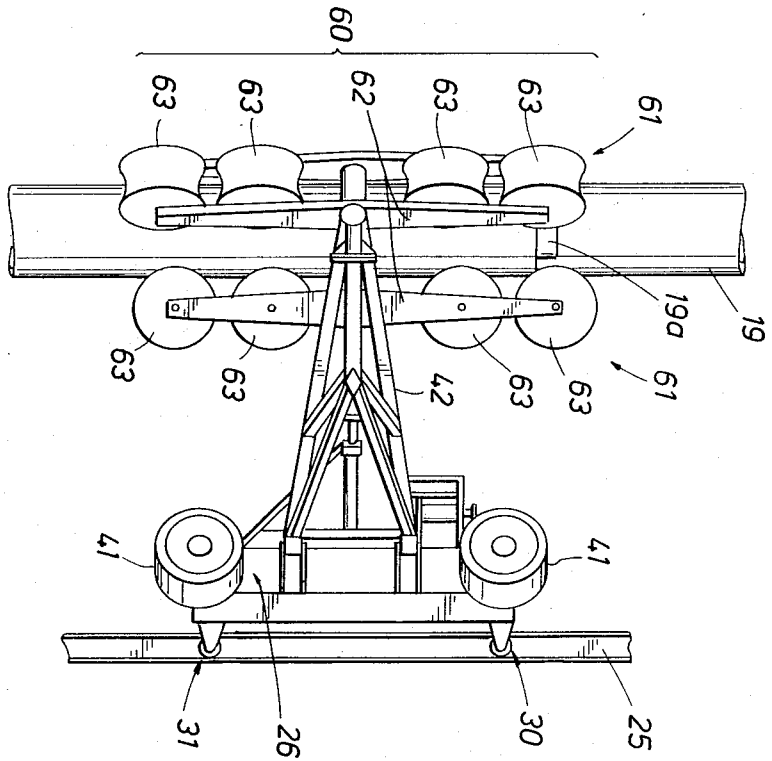
FIG. 5 is a side view of the guidance vehicle taken along line 5—5 of FIG. 6.

In carrying out drilling and completion operations from vessel 10, various drill strings or risers and equipment will be guided by vehicle 18. To accomplish this task, interchangeable workhead assemblies are attached to the arm assemblies of the guidance vehicle. One such workhead assembly is shown in FIGS. 2, 5, and 6. Roller workhead assembly 60 is used for running in risers which have thin-skinned buoyancy cans attached. Roller workhead assembly 60 comprises three roller arm assemblies 61 which are attached to each side arm 42 and center arm 46, respectively. Each roller arm assembly 61 comprises walking beam 62 and four rollers 63. The centers of the rollers are spaced at a specific interval so that the rollers will bridge the gaps 19*a* (FIGS. 2 and 5) between the buoyancy cans as riser 19 is run.

Roller arm assembly 61 for center arm 46 is mounted on spindle 49 (FIG. 3) so that it can rotate about the spindle. This allows the roller arm assembly 61 on center arm 46 to maintain a substantially parallel position in relation to the wall of moonpool 16 as center arm 46 is moved to an open or closed position. Spindle 49, as illustrated in FIG. 3, is locked into place by pin 49*a*.

A second interchangeable workhead assembly is shown in FIG. 3. Funnel workhead assembly 70 is used to guide such things as bare drill pipe, wire rope, or tie back tubing. Assembly 70 comprises a pair of funnel members 71, 72, which have smooth, semicircular inner surfaces 73, 74. The two funnel members are mounted on side arms 42. Center arm 46 on vehicle 18 is not used with funnel workhead assembly 70 and is left in its retracted or open position. Members 71, 72 are staggered vertically so that the ends of the members overlap when side arms 42 are in a closed position, encircling the string being handled.

Figure 7:
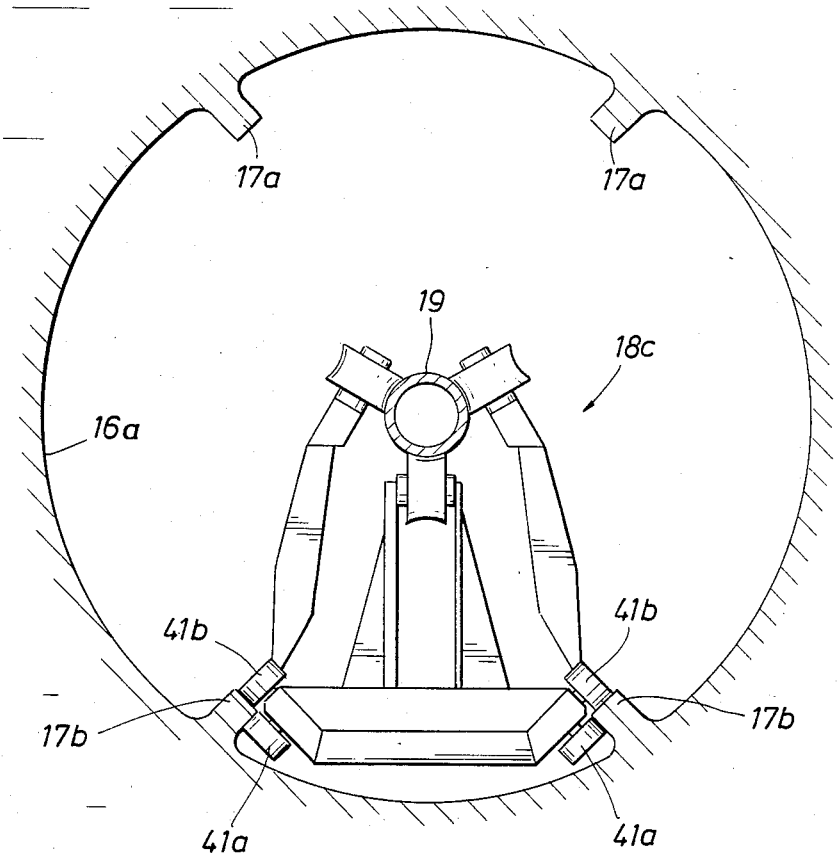
FIG. 7 is a view similar to FIG. 6 showing an alternate embodiment of the present invention.

FIG. 7 discloses an alternate embodiment of the present invention. In this embodiment each of the guidance vehicles utilize curbs, instead of the monorail 25 described above, to retain and guide the vehicle along the wall of the moonpool. Where caisson vessel 10 is formed of concrete, as will often be the case, two pairs of curbs 17*a*, 17*b* can be slip-formed on the wall of moonpool 16*a* during construction. Sets of wheels 41*a*, 41*b* are provided at each of the four corners of the frame (only upper two corners shown in FIG. 7). Wheels 41*a* ride on the inner side walls of two adjacent curbs to maintain vehicle 18*c* within the track formed between a set of curbs. Wheels 41*b* ride on the outer edges of the curbs and allow vehicle 18*c* to move up and down the wall of moonpool 16*a* under control of a lift line and winch (not shown). The remainder of the structure of vehicle 18*c* and its associated workheads 60 and 70 is similar to that previously described.

Guidance vehicles 18*a*, 18*b* can be used to provide lateral support for a drill string or riser just above the flex joint during drilling operations. However, the loads which may be generated on the guidance vehicles while drilling under storm conditions can cause the guidance vehicles to fail. Accordingly, it is desirable to rely on a flex joint centralizer 80 (FIGS. 1 and 2) in the drill string or riser near the bottom of moonpool 16 to provide the required lateral support during such operations.

FIGS. 8–13 disclose a preferred embodiment of flex joint centralizer 80 which can be used with the present invention. The basic component of flex joint centralizer 80 is a spool 81 which is shown in FIG. 8. This spool 81 becomes an integral part of drill string or riser 19 when flex joint centralizer 80 is installed. Spool 81 has a coupling 82 on its upper end which is to be connected to an adjacent joint in drill string or riser 19. Flange 83 at the lower end of spool 81 is to be secured to flange 84 on flex joint 85 in drill string or riser 19. Welded near the center of spool 81 is flange 86 for mounting centralizing arm assembly 95, which is described below. Connection sections 87 are provided on spool 81 for the auxiliary hydraulic, air, and control lines which run along drill string or riser 19. Connection sections 87 pass through openings 88 in mounting flange 86 (FIG. 10). The continuous umbilicals 89 (FIG. 12) for BOP control that run down drill string or riser 19 are tucked into slots 90 on flange 86. Returning to FIG. 8, lugs 92 are welded to spool 81 near lower flange 83. Four hydraulic cylinders 91 are secured at one end to lugs 92.

Figure 9:
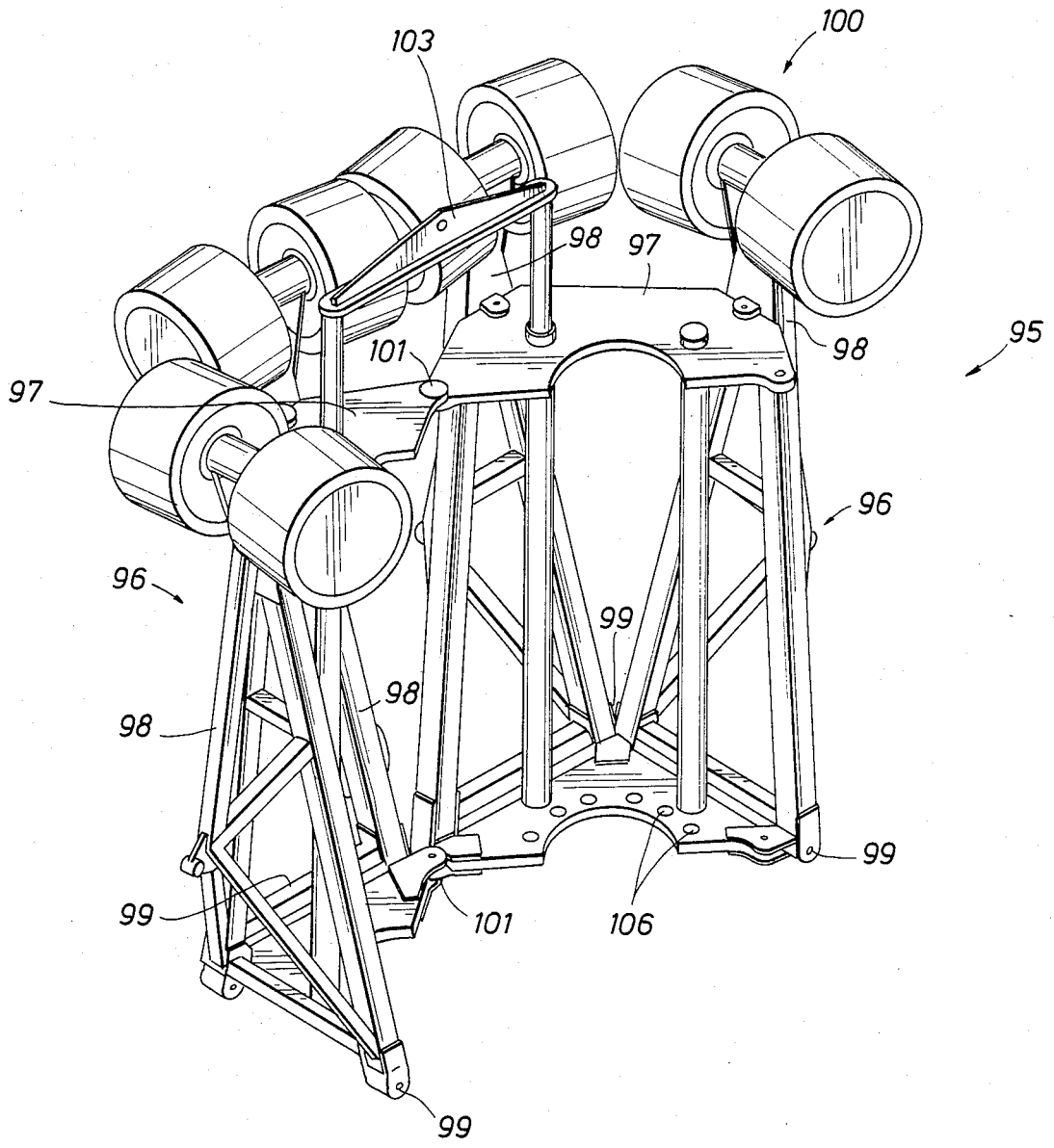
FIG. 9 is a perspective view of a centralizing arm assembly in a disassembled position.

Centralizing arm assembly 95 of flex joint centralizer 80 is shown in FIGS. 9–11. Assembly 95 comprises two identical halves 96. Each half 96 has a frame 97 with two identical suspension elements 98 mounted on each frame. Suspension elements 98 pivot about axes 99. Each element 98 is composed of a truss with a wheel assembly 100 at its outer end. The two halves are joined together by pivot pins 101.

A typical operation using this system is set forth below. Referring to FIG. 1, drilling template 21 is secured under vessel 10. The vessel is then towed to and moored at a selected location in water 12. Drilling template 21 is lowered to and positioned on marine bottom 22 by lowering lines (not shown). These lines are guided through moonpool 16 by guidance vehicle 18*b* using funnel workhead assembly 70 (not shown). The lowering lines are released and funnel workhead assembly 70 is used to guide the lines as they are withdrawn through moonpool 16.

Next, rails (not shown) are extended across moonpool 16 from lower workdeck 14*a*. Package 20 is rolled from deck 14*a* onto the rails over the moonpool. The lower end of drill string or riser 19 is attached to package 20. The funnel workhead assembly 70 is removed from guidance vehicles 18*a*, 18*b*. The roller arm assemblies 61 (FIG. 2) of roller workhead assembly 60 are attached to side arms 42 and center arm 46 of both vehicles. Rollers 63 of roller workhead assembly 60 on lower guidance vehicle 18*b* are engaged on drill string or riser 19 just above package 20. Roller workhead assembly 60 on upper guidance vehicle 18*a* is in the fully retracted position at this time.

The rails are withdrawn onto deck 14*a*, and drill string or riser 19, with package 20 attached, is made up and lowered through moonpool 16. Line 51 to vehicle 18*b* is payed out from winch 52 to allow lower vehicle 18*b* to follow and guide drill string or riser 19 and package 20 downward in moonpool 16. Vehicle 18*b* is lowered until it reaches the end of its monorail 25. After a predetermined length of drill string or riser 19 has been run, depending on actual water depth, flex joint 85 and flex joint centralizer 80 are coupled into riser 19.

Flex joint 85 is first installed into riser 19. Spool 81 is then mated to flex joint 85. This assembly takes place on platform 14. Centralizing arm assembly 95, when assembled, is too large to pass through the opening in platform 14, so it must be installed on a lower deck. Additional joints of drill string or riser are added and flex joint 85 and attached spool 81 are lowered to a point adjacent work deck 14*a*, where centralizing arm assembly 95 will be installed. At deck 14*a*, all plumbing line connection sections 87 are made up and umbilicals 89 are positioned in slots 90 on mounting flange 86.

Figure 12:
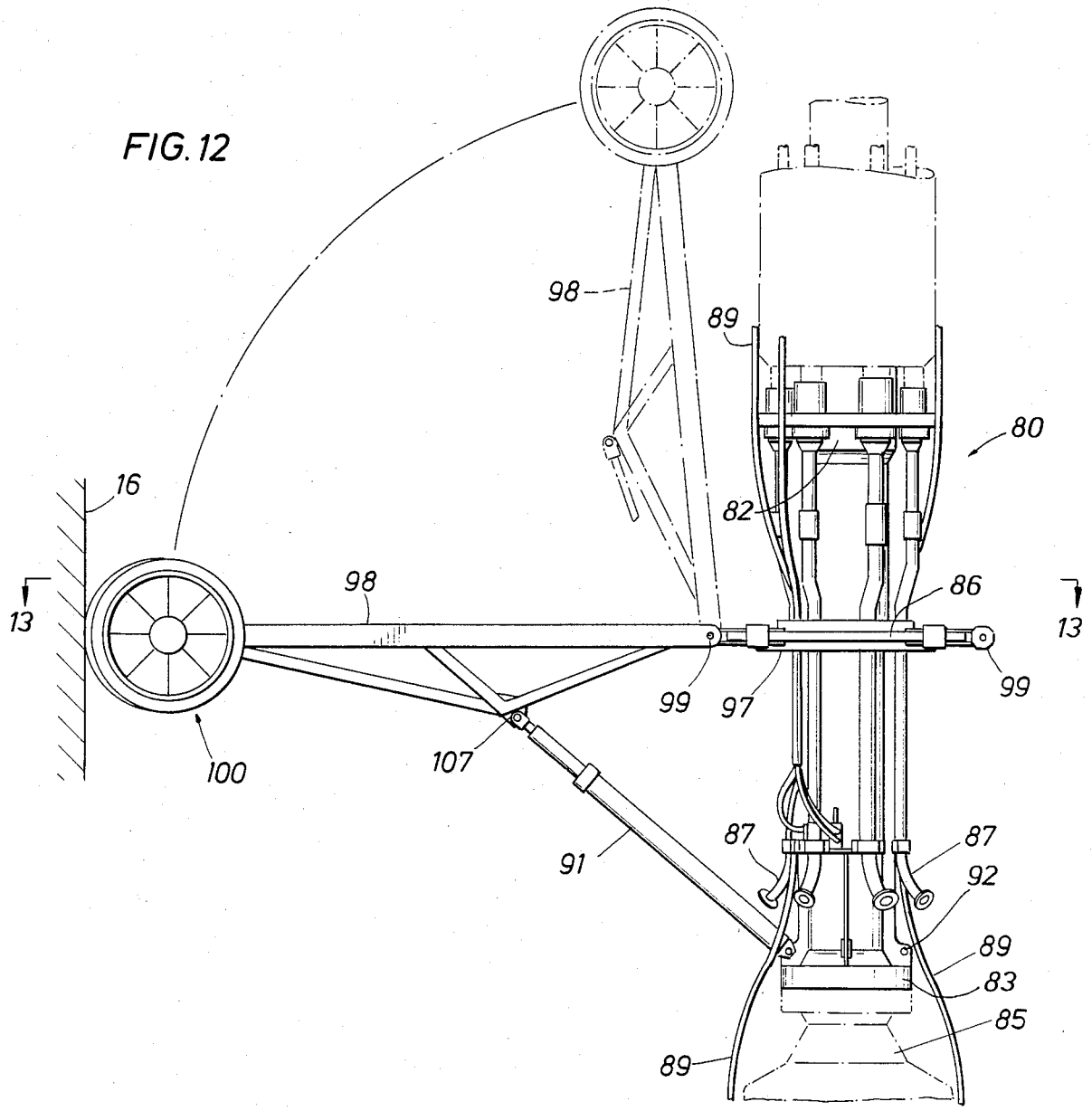
FIG. 12 is a partial elevation of the centralizer in an operable position.
Figure 13:
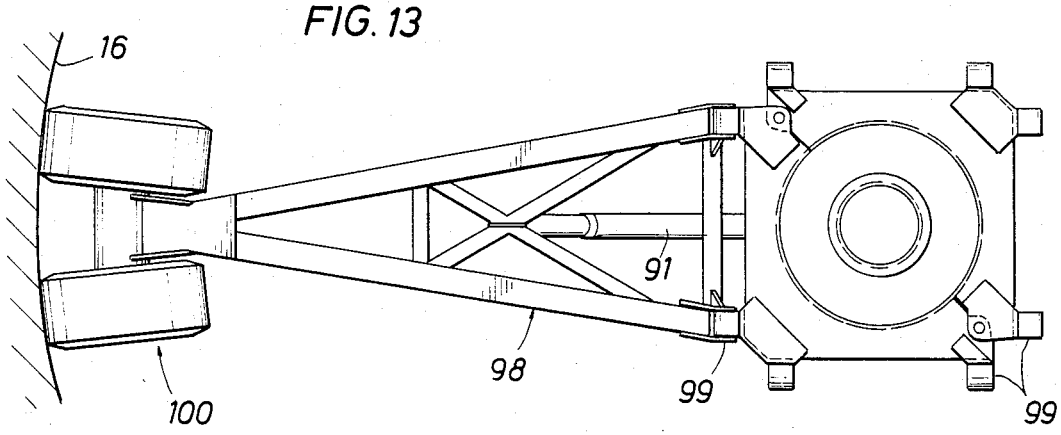
FIG. 13 is a plan view taken along line 13—13 of FIG. 12.

Assembly 95 is then lifted, using lifting bracket 103 (FIG. 9), onto flange 86 in an open position (FIG. 10). It is aligned so that suspension elements 98 on one of assembly halves 96 line up with hydraulic cylinders 91 on spool 81. That half 96 of centralizing arm assembly 95 is then bolted through holes 106 to flange 86 and lifting bracket 103 is removed. Centralizing arm assembly 95 is then closed (FIG. 11) and the other half 96 is bolted to flange 86. Hydraulic cylinders 91 are next connected to elements 98 with pins 107 (FIG. 12).

With flex joint centralizer 80 now assembled, side arms 42 and center arm 46 of upper vehicle 18*a* are actuated to move roller workhead assembly 60 into contact with drill string or riser 19 just above flex joint centralizer 80. Line 51 to vehicle 18*a* is then payed out to allow upper vehicle 18*a* to follow flex joint centralizer 80 downward in moonpool 16.

As flex joint centralizer 80 approaches the parked lower vehicle 18*b*, arms 42 and 46 on that vehicle are retracted to allow the flex joint to pass. Package 20 is then lowered the remaining distance to its final position on drilling template 21. The suspension elements 98 on flex joint centralizer 80 then begin to deploy (FIG. 12). Upper vehicle 18*a*, now parked at the end of its monorail 25, continues to center and support drill string or riser 19 while the suspension elements are being deployed by hydraulic cylinders 91. This action brings wheel assemblies 100 into contact with moonpool 16 (FIGS. 11 and 12).

Flex joint centralizer 80 is then checked out with the closed-circuit television on one of guidance vehicles 18*a*, 18*b*. Vehicle 18*a* is disengaged and both vehicles can be retrieved onto platform 14 of vessel 10 until they are needed for other operations. To remove flex joint centralizer 80 and drill string or riser 19, the above described steps are reversed.

The foregoing disclosure and description of the invention are only illustrative and explanatory thereof. Various changes in size, shape, materials of construction, and configuration, as well as changes in the details of the illustrated construction may be made within the scope of the appended claims without departing from the spirit of the invention.

What is claimed is:

1. A system for guiding drill strings or risers through a moonpool of a floating structure, said moonpool having a wall, a top, and a bottom, said system comprising:

one or more tracks on the wall of said moonpool extending vertically from the top of said moonpool to a point near the bottom thereof, wherein each said track comprises a monorail on the wall of the moonpool;

one or more guidance vehicles each movingly mounted to one of said one or more tracks; and means for raising or lowering said vehicles along their respective tracks.

2. The system of claim 1 wherein said monorail comprises an I-beam.

3. The system of claim 2 wherein said means for movingly mounting said guidance vehicle on said I-beam comprises:

a frame having two side structures and upper, intermediate, and lower cross supports;

a first pair of rollers mounted on said frame near the top thereof, each wheel adapted to be positioned within a different channel of said I-beam and adapted to roll within that channel; and a second pair of rollers mounted on said frame near the bottom thereof, each wheel adapted to be positioned within a different channel of said I-beam and adapted to roll within that channel.

4. A system for guiding drill strings or risers through a moonpool of a floating structure, said moonpool having a wall, a top, and a bottom, said system comprising:

one or more tracks on the wall of said moonpool extending vertically from the top of said moonpool to a point near the bottom thereof;

one or more guidance vehicles each movingly mounted to one of said one or more tracks; and means for raising or lowering said vehicles along their respective tracks, wherein each said track comprises a pair of curbs spaced apart from each other on the wall of the moonpool, each curb having inner and outer curbs, said inner curb forming an acute angle with the moonpool wall, and said outer curb being perpendicular to said inner curb.

5. The system of claim 4 wherein said means for mounting said guidance vehicle on said track comprises:

a frame having two side structures and upper, intermediate, and lower cross supports;

wheels mounted on the side of said frame at each corner, each of said wheels adapted to be positioned on the inner side of a respective curb of said track; and wheels mounted on the side of said frame at each corner, each of said wheels adapted to be positioned on the outer side of a respective curb of said track.

6. A guidance vehicle for guiding drill string or risers through a cylindrical moonpool having a wall and a central axis and located in a floating structure, said guidance vehicle comprising:

a frame;

means on said frame for mounting said frame on a track on the wall of the moonpool;

means on said frame for engaging drill strings or risers and for centering said drill strings or risers within the moonpool comprising:

(i) first and second side arms, each of said side arms pivotably mounted at an inner end about an axis parallel to the side of the moonpool and on a side of the frame so that the arms close together at the outer ends when moved to a closed position, (ii) workhead means on an outer end of each of said side arms adapted to engage a particular drill string or riser when said side arms are in a closed position, including:

(a) a first funnel member secured to the outer end of a first of the side arms, said first funnel member having a substantially semicircular inner surface, and (b) a second funnel member secured to the outer end of the second of said side arms, said second funnel member having a substantially semicircular inner surface which is offset from the semicircular inner surface on said first member so that when said side arms are in a closed position, the drill string or riser will be completely encircled by said semicircular inner surfaces of said first and second members, (iii) a center arm having an inner and an outer end, mounted on an inner end about a pivot on said frame so that the arm moves from an attitude generally parallel to the moonpool wall in an open position to an attitude generally perpendicular to the moonpool wall in a closed position, and (iv) workhead means on the outer end of said center arm adapted to engage a particular drill string or riser when said center arm is in a closed position; and means for actuating said engaging and centering means comprising hydraulic cylinder means attached between said frame and each of said first and second side arms and positioned for rotating each of said arms about its respective pivot when actuated.

7. The guidance vehicle of claim 6 wherein said workhead means comprises:

walking beams secured to the outer end of each of said first and second side arms and said center arm wherein the axis of each said walking beam is generally parallel to the drill string or riser; and a plurality of rollers spaced along the length of said walking beam, each of said rollers being adapted to engage said drill string or riser.

8. The guidance vehicle of claim 7 wherein said means for actuating said engaging and centering means further comprises:

hydraulic cylinder means attached between the frame and each of said first and second side arms and positioned for rotating each of said side arms about its respective pivot when actuated; and hydraulic cylinder means attached between the frame and the center arm and positioned for rotating said center arm about its pivot when actuated.

9. A system for guiding drill strings or risers through a moonpool of a floating structure, said moonpool having a wall, a top and a bottom, said system comprising:

one or more tracks on the wall of said moonpool extending vertically from the top of said moonpool to a point near the bottom thereof;

one or more guidance vehicles each movingly mounted to one of said one or more tracks, each of said guidance vehicles comprising:

(i) a frame having two side structures, and upper, intermediate, and lower cross supports, (ii) means on said frame for movably mounting said frame on one of the tracks, (iii) first and second side arms, each of said side arms having inner and outer ends, pivotably mounted at said inner end about an axis parallel to the side of the moonpool and on a side of said frame so that the arms close together at the outer ends when moved to a closed position, (iv) actuating means on said frame for rotating each of said first and second side arms about their respective axes between an opened and a closed position, said actuating arms including hydraulic cylinder arms attached between the frame and each of said side arms and positioned for rotating each of said side arms about its respective pivot when actuated, (v) workhead means on the outer ends of said first and second arms adapted to engage drill string or risers when said arms are in the closed position, and (vi) a wheel mounted at each corner of the frame, each wheel adapted to engage and roll up or down the wall of the moonpool when said frame is movably mounted on a track; and means for raising or lowering said guidance vehicles along their respective tracks.

10. The system of claim 9 wherein said guidance vehicle further comprises:

a center arm having an inner and an outer end, mounted on an inner end about a pivot on the frame so that the arm moves from an attitude generally parallel to the moonpool wall in an open position to an attitude generally perpendicular to the moonpool wall in a closed position; and actuating means on said frame for rotating said center arm about said pivot between the open position and the closed position.

11. The system of claim 10 wherein said workhead means comprises:

walking beam secured to the outer end of each of said first and second side arms and to the outer end of the center arm wherein the axis of each of said walking beams is parallel to the drill string or riser; and a plurality of rollers spaced along the length of each of said walking beams, each of said rollers being adapted to engage said drill string or riser when said arms are in a closed position.

12. The system of claim 10 wherein said workhead means comprises:

a first funnel member secured to the outer end of said first side arm, said first funnel member having a substantially, semicircular inner surface thereon; and a second funnel member secured to the outer end of said second side arm, said second funnel member having a substantially semicircular inner surface thereon which is offset from the semicircular inner surface on said first funnel member whereby when said first and second side arms are in a closed position, the drill string or riser will be completely encircled by said semicircular inner surfaces of said first and second funnel members.

13. The system of claim 10 wherein said actuating means for rotating the center arm comprises hydraulic cylinder means attached between the frame and said center arm and positioned for rotating said center arm about its pivot when actuated.

* * * * *